US006123572A

United States Patent [19]

Ishii et al.

[11] Patent Number: 6,123,572

[45] Date of Patent: Sep. 26, 2000

[54] MODULAR PLUG FOR A SIGNAL TRANSMISSION CABLE

[75] Inventors: Takuji Ishii; Toshiki Tamura, 4-15-9 Nakan Nakanoku; Masahito Watanabe, all of Tokyo, Japan

[73] Assignees: Toshiki Tamura, Tokyo, Japan; Tsan-Hsun Lin, Taipei, Taiwan

[21] Appl. No.: 09/419,223

[22] Filed: Oct. 15, 1999

[51] Int. Cl.[7] ..... H01R 13/58; H01R 13/14; H01R 11/20

[52] U.S. Cl. ..... 439/465; 439/418; 439/460; 439/467; 439/676

[58] Field of Search ..... 439/418, 460, 439/465, 467, 676, 941

[56] References Cited

U.S. PATENT DOCUMENTS

| | | | |
|---|---|---|---|
| 4,373,766 | 2/1983 | Johnston | 439/344 |
| 4,950,176 | 8/1990 | Cocco et al. | 439/344 |
| 5,888,100 | 3/1999 | Bofill et al. | 439/676 |
| 5,899,770 | 5/1999 | Ezawa | 439/418 |
| 6,017,237 | 1/2000 | Sullivan | 439/392 |

*Primary Examiner*—Paula Bradley
*Assistant Examiner*—Edwin A. León
*Attorney, Agent, or Firm*—Christensen O'Connor Johnson Kindness PLLC

[57] ABSTRACT

A modular plug includes a dielectric housing, a plurality of terminals, and a signal transmission cable. The dielectric housing has a cable insertion end, a mating end opposite to the cable insertion end, a lower body portion, and an upper lid portion connected to the lower body portion. The lower body portion extends from the cable insertion end to the mating end. The lower body portion has a plurality of terminal grooves formed adjacent to the mating end, and a cable receiving space extending from the cable insertion end adjacent to the terminal grooves. The upper lid portion is operable relative to the lower body portion to expose the cable receiving space. The terminals are inserted into the cable receiving space through the terminal grooves. The signal transmission cable is received in the cable receiving space, and has a plurality of conductive wires that extend adjacent to the terminal grooves, respectively, and that are connected electrically to the terminals. The upper lid portion lies over the cable receiving space without extending to the terminal grooves, and has a protrusion projecting into the cable receiving space to press the signal transmission cable against the lower body portion.

8 Claims, 4 Drawing Sheets

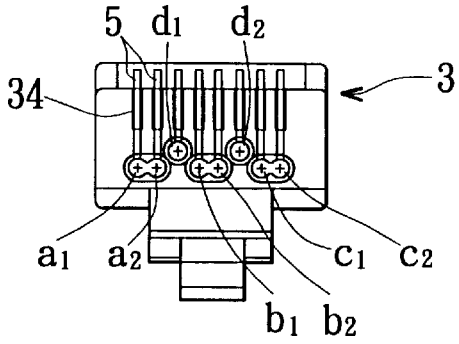
FIG. 8
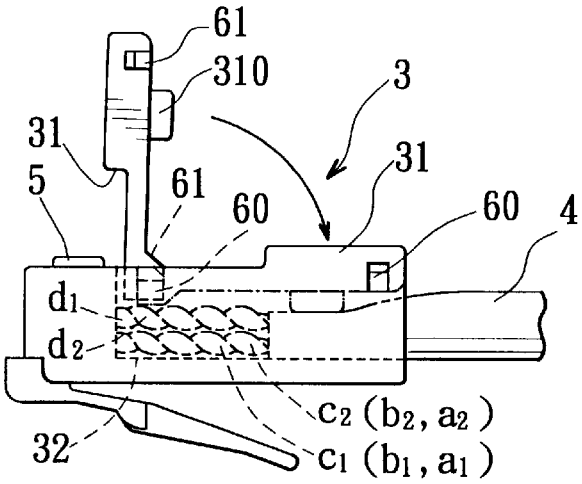
FIG. 9
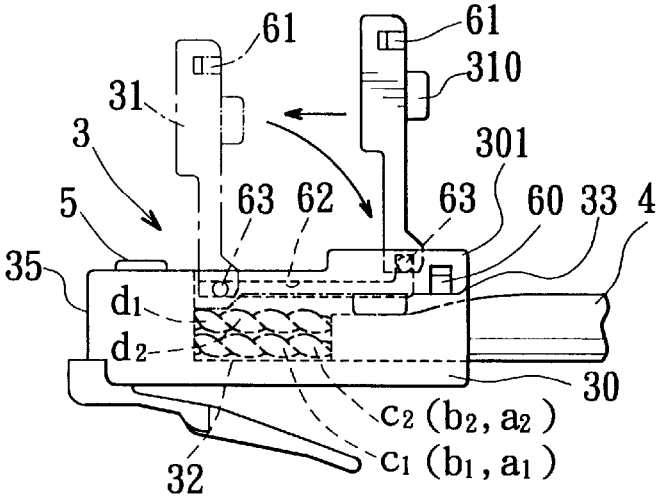
FUG. 10

MODULAR PLUG FOR A SIGNAL TRANSMISSION CABLE

BACKGROUND OF THE INVENTION

1. Field of the Invention

This invention relates to an electrical connector, more particularly to an electrical connector for a signal transmission cable.

2. Description of the Related Art

Referring to FIGS. 1, 2 and 3, a conventional modular plug is shown to comprise a signal transmission cable 1, a dielectric housing 2 having a cable insertion end 20 and a mating end 26 that is opposed to the cable insertion end 20, and a plurality of conductive terminals 22. The signal transmission cable 1 is a local area network (LAN) cable and has four twin-twisted strands (d1, d2, b1, b2, a1, a2, c1, c2) that are enclosed by an insulative covering 10. Each of the twin-twisted strands (d1, d2, b1, b2, a1, a2, c1, c2) has a conductive wire 101 that is surrounded by an insulative layer 100. The twin-twisted strands (d1, d2, b1, b2, a1, a2, c1, c2) include a first twin-twisted strand (d1, d2) for transmitting signals, a second twin-twisted strand (b1, b2) for network telephone use, a third twin-twisted strand (a1, a2) for receiving signals, and a fourth twin-twisted strand (c1, c2) for modem use and other purposes. In assembly, the twin-twisted strands (d1, d2, b1, b2, a1, a2, c1, c2) are untwisted and straightened and are then are inserted into a cable receiving space 21 through the cable insertion end 20 of the dielectric housing 2. The ends of the twin-twisted strands (d1, d2, b1, b2, a1, a2, c1, c2) extend to a plurality of terminal grooves 23 formed adjacent to the mating end 26. The terminals 22 are inserted into the cable receiving space 21 through the terminal grooves 23 and pierce the insulative layers 100 for electrical connection with the conductive wires 101, respectively.

If the signal transmission cable 1 is a local area network cable of category 4, the frequency thereof can only reach 40 MHz. Therefore, such a signal transmission cable 1 can only be used in 10 Base T (IEEE 802.3 telecommunication standard). The arrangement of the twin-twisted strands (d1, d2, b1, b2, a1, a2, c1, c2) in the dielectric housing 2 for such a signal transmission cable 1 is shown in FIG. 4. To meet the requirements for high network communication speed and high quality, a high-speed local area network cable is developed to reach a higher frequency, i.e. 100 MHz. Therefore, the high-speed local area network cable can be used in 10 Base T and 100 Base T. In this case, the arrangement of the twin-twisted strands (d1, d2, b1, b2, a1, a2, c1, c2) in the dielectric housing 2 is shown in FIG. 5.

The aforementioned conventional modular plug suffers from the following disadvantages:

1. Insertion of the untwisted and straightened twin-twisted strands (d1, d2, b1, b2, a1, a2, c1, c2) into the dielectric housing 2 through a narrow insert hole formed in the cable insertion end 20 is difficult to perform during assembly of the conventional electrical connector.

2. Untwisting and straightening the twin-twisted strands (d1, d2, b1, b2, a1, a2, c1, c2) will reduce the frequency to which the single transmission cable can be used and will produce crosstalk, thereby affecting adversely the network telecommunication speed and quality.

3. In either case of the local area network cables of category 4 or category 5, the first twin-twisted strands (d1, d2) and the second twin-twisted strands (b1, b2) are twisted relative to one another. Therefore, when signals are transmitted from the first twin-twisted strand (d1, d2), it is liable to be interfered by the second twin-twisted strand (b1, b2), thereby resulting in noise. This will adversely affect the network telecommunication speed and quality. The noise interference is particularly serious when the signal transmission speed of the signal transmission cable is increased to about 300 MHz.

SUMMARY OF THE INVENTION

The object of the present invention is to provide a modular plug that can overcome the disadvantages that are commonly associated with the aforementioned conventional electrical connector.

According to the present invention, a modular plug comprises a dielectric housing, a plurality of terminals, and a signal transmission cable. The dielectric housing has a cable insertion end, a mating end opposite to the cable insertion end, a lower body portion, and an upper lid portion connected to the lower body portion. The lower body portion extends from the cable insertion end to the mating end. The lower body portion has a plurality of terminal grooves formed adjacent to the mating end, and a cable receiving space extending from the cable insertion end adjacent to the terminal grooves. The upper lid portion is operable relative to the lower body portion to expose the cable receiving space. The terminals are inserted into the cable receiving space through the terminal grooves. The signal transmission cable is received in the cable receiving space, and has a plurality of conductive wires that extend adjacent to the terminal grooves, respectively, and that are connected electrically to the terminals. The upper lid portion lies over the cable receiving space without extending to the terminal grooves, and has a protrusion projecting into the cable receiving space to press the signal transmission cable against the lower body portion.

BRIEF DESCRIPTION OF THE DRAWINGS

Other features and advantages of the present invention will become apparent in the following detailed description of the preferred embodiments of the invention, with reference to the accompanying drawings, in which:

FIG. 8 is an end view of the first preferred embodiment, illustrating four twin-twisted strands arranged in the modular plug of the first preferred embodiment;

FIG. 9 is a side schematic view illustrating how an upper lid portion operates relative to a lower body portion of the first preferred embodiment; and FIG. 10 is a side schematic view illustrating how an upper lid portion operates relative to a lower body portion of a second preferred embodiment of a modular plug according to the present invention.

DETAILED DESCRIPTION OF THE PREFERRED EMBODIMENTS

Figure 1:
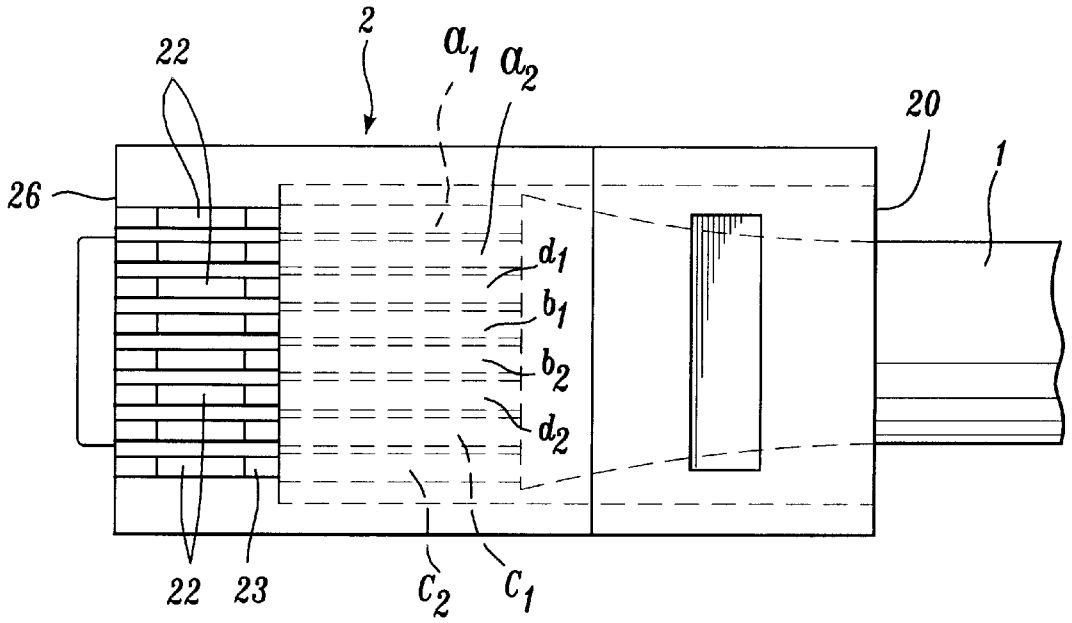
Fig. 1. PRIOR ART
FIG. 1 is a top view of a conventional modular plug.
Figure 2:
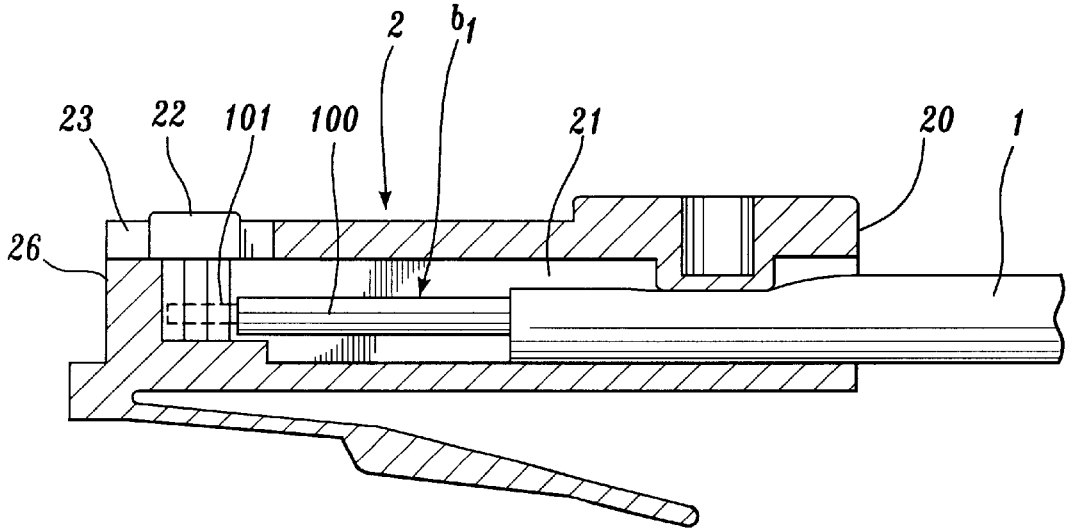
Fig. 2. PRIOR ART
FIG. 2 is a cross sectional view of the conventional modular plug of FIG. 1.
Figure 3:
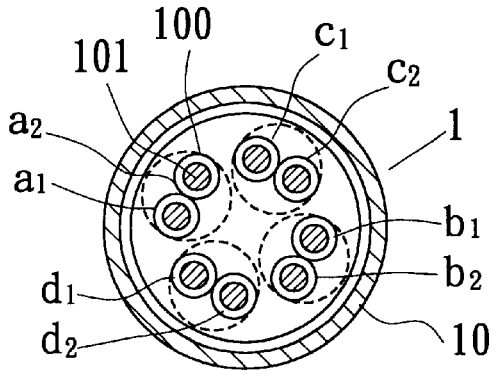
FIG. 3 PRIOR ART
FIG. 3 is a cross sectional view of a conventional signal transmission cable.
Figure 4:
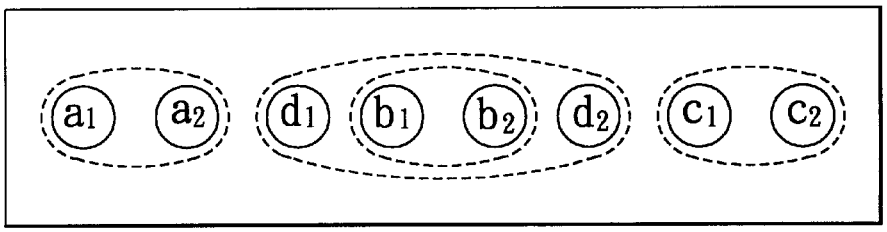
FIG. 4 PRIOR ART
FIG. 4 is a cross sectional schematic view of four twin-twisted strands of a first signal transmission cable that are arranged within the conventional modular plug.
Figure 5:
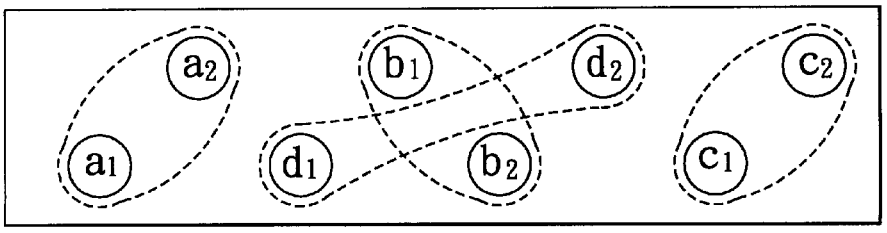
FIG. 5 PRIOR ART
FIG. 5 is a cross sectional schematic view of four twin-twisted strands of a second signal transmission cable that are arranged within the conventional modular plug.

Before the present invention is disclosed in greater detail, it should be noted that like elements are denoted by the same reference numerals throughout the disclosure.

Figure 6:
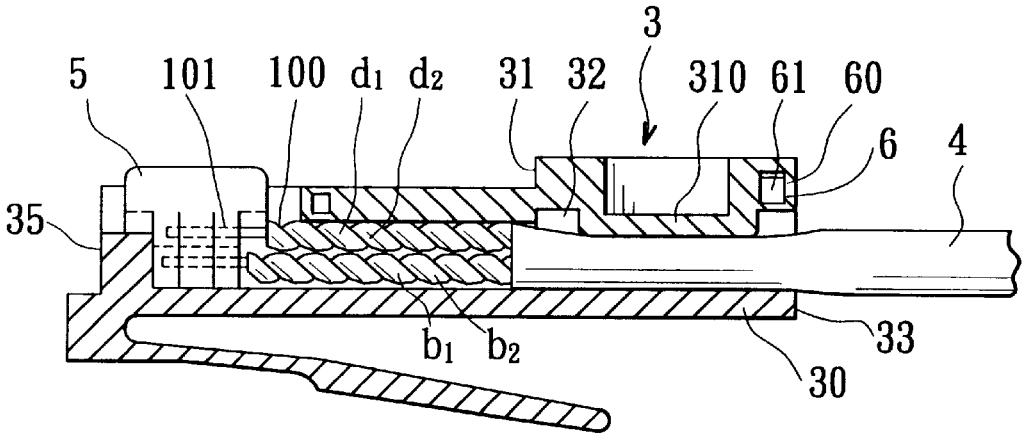
FIG. 6 is a cross sectional view of a first preferred embodiment of a modular plug according to the present invention.
Figure 7:
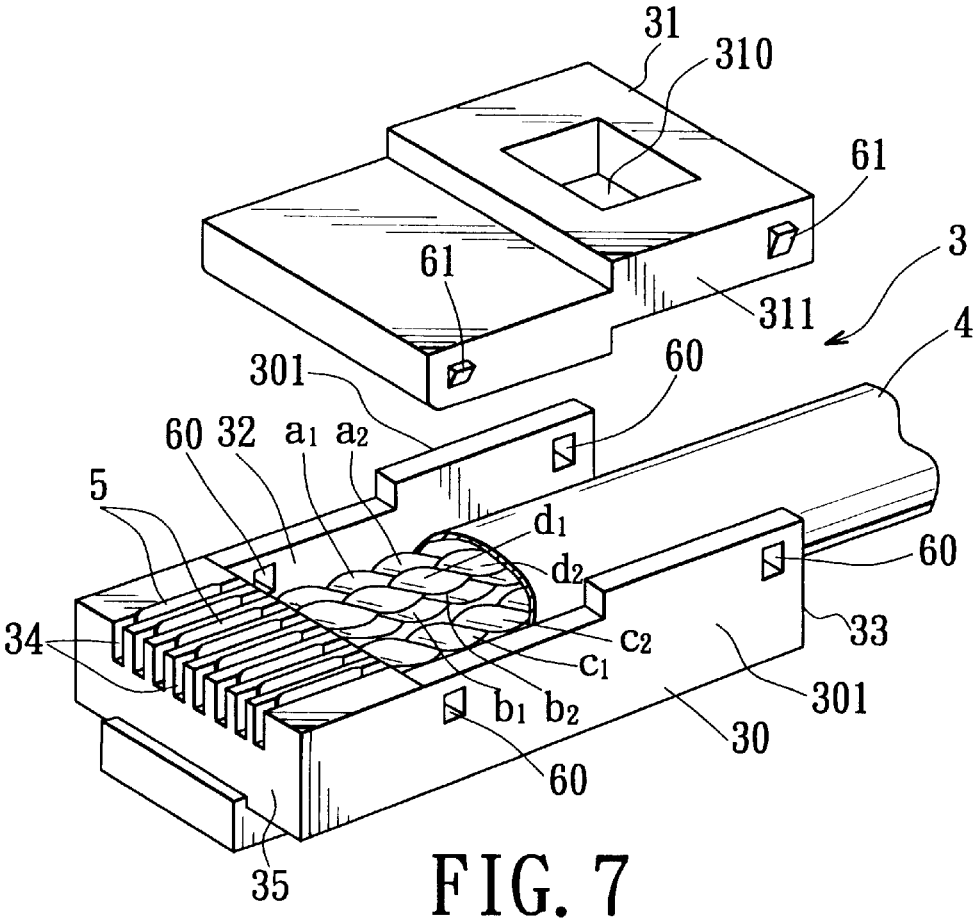
FIG. 7 is an exploded view of the first preferred embodiment.

Referring to FIGS. 6 and 7, a first preferred embodiment of a modular plug according to the present invention is shown to comprise a dielectric housing 3, a signal transmission cable 4, and a plurality of conductive terminals 5. The modular plug includes an RJ45 (IEEE 802.3 telecommunication standard) signal plug and a local area network cable serving as the signal transmission cable 4, and is suitable for use as a signal plug connector for high speed local area network of category 6. The frequency of the signals carried by the aforementioned modular plug can reach 350 MHz–500 MHz.

The dielectric housing 3 has a cable insertion end 33, a mating end 35 opposite to the cable insertion end 33, a lower body portion 30, and an upper lid portion 31 connected to the lower body portion 30 by interlocking means 6. The lower body portion 30 extends from the cable insertion end 33 to the mating end 35. The lower body portion 30 has a plurality of terminal grooves 34 formed adjacent to the mating end 35, and a cable receiving space 32 extending from the cable insertion end 33 adjacent to the terminal grooves 34. The terminal grooves 34 are located above the cable receiving space 32. The upper lid portion 31 is operable relative to the lower body portion 30 to expose the cable receiving space 32. The signal transmission cable 4 is received in the cable receiving space 32, and has four twin-twisted strands (d1, d2, b1, b2, a1, a2, c1, c2) that extend adjacent to the terminal grooves 34, respectively. Each of the twin-twisted strands (d1, d2, b1, b2, a1, a2, c1, c2) has a conductive wire 101 that is surrounded by an insulative layer 100. The twin-twisted strands (d1, d2, b1, b2, a1, a2, c1, c2) include a first twin-twisted strand (d1, d2) for transmitting signals, a second twin-twisted strand (b1, b2) for network telephone use, a third twin-twisted strand (a1, a2) for receiving signals, and a fourth twin-twisted strand (c1, c2) for modem use and other purposes. It is noted that the twin-twisted strands (d1, d2, b1, b2, a1, a2, c1, c2) are arranged in the cable receiving space 32 without being untwisted. In addition, the first and second twin-twisted strands (d1, d2, b1, b2) extend respectively in the cable receiving space 32 at different levels and are isolated from one another. The first twin-twisted strand (d1, d2) is located above the second twin-twisted strand (b1, b2), as best illustrated in FIG. 8. The third and fourth twin-twisted strands (a1, a2, c1, c2) are located below the first twin-twisted strand (d1, d2). Since the first and second twin-twisted strands (d1, d2, b1, b2) are located at different levels and are separated from each other without being twisted relative to each other, the signals carried respectively by the first and second twin-twist strands (d1, d2, b1, b2) will not interfere with one another. Therefore, the signal transmission cable 4 is suitable for use during transmission of high frequency signals.

The terminals 5 are inserted into the cable receiving space 32 through the terminal grooves 34 and pierce the insulative layers 100 for electrical connection with the conductive wires 101, respectively. The upper lid portion 31 lies over the cable receiving space 32 without extending to the terminal grooves 34, and has a protrusion 310 projecting into the cable receiving space 32 to press the signal transmission cable 4 against a bottom face of the lower body portion 30. Therefore, the signal transmission cable 4 can be positioned firmly within the dielectric housing 3.

The lower body portion 30 has two opposed first side walls 301 extending from the mating end 35 to the cable insertion end 33. The lid 31 has two opposed second side walls 311 extending along lines parallel to the first side walls 301. The interlocking means 6 includes two pairs of holes 60 formed respectively in the first side walls 301 adjacent to the mating end 35 and the cable insertion end 33. The upper lid portion 31 has two pairs of projections 61 that are formed respectively on the second side walls 311 and that snap correspondingly into the holes 60.

In assembly, with reference to FIGS. 6, 7 and 8, the upper lid portion 31 is opened relative to the lower body portion 30. The signal transmission cable 4 is then inserted into the cable receiving space 32 through the cable insertion end 33. At this time, the second, third and fourth twin-twisted strands (b1, b2, a1, a2, c1, c2) extend to and below the terminal grooves 34 at the same level on the bottom face of the dielectric housing 3 while the first twin-twisted strand (d1, d2) is located above the second, third and fourth twin-twisted strands (b1, b2, a1, a2, c1, c2). Thereafter, the upper lid portion 31 is compressed onto the lower body portion 30 to enable the protrusion 310 to press the signal transmission cable 4 against the lower body portion 30, and to enable the projections 61 to snap correspondingly into the holes 60. As such, the upper lid portion 31 can be locked to the lower body portion 30 and the signal transmission cable 4 can be positioned firmly between the upper lid portion 31 and the lower body portion 30. Finally, the terminals 5 are inserted into the terminal grooves 34 and pierce the insulative layers 100 to contact the conductive wires 101 by a punching process. It is noted that since the signal transmission cable 4 is not interfered by the protrusion 310 while being inserted into the cable receiving space 32, assembly of the modular plug is relatively simple and easy to conduct. In addition, since the twin-twisted strands (d1, d2, b1, b2, a1, a2, c1, c2) are not untwisted in the dielectric housing 3, the problems of signal frequency reduction and crosstalk in the signal transmission cable 4 can be minimized. Moreover, the protrusion 310 can be made larger than that of the aforementioned conventional modular plug in order to increase the effective contact area between the protrusion 310 and the signal transmission cable 4, thereby increasing the clamping force exerted on the signal transmission cable 4.

FIG. 10 illustrates a second preferred embodiment of a modular plug according to the present invention. In this embodiment, the interlocking means 6 includes a pair of holes 60 formed respectively in the first side walls 301 adjacent to the cable insertion end 33, and two slide grooves 62 formed respectively in the first side walls 301 and extending in a direction from the mating end 35 to the cable insertion end 33. The upper lid portion 31 has a pair of projections 61 that are formed respectively on the second side walls 311 adjacent to the cable insertion end 33 and that snap correspondingly into the holes 60, and two pivot pins 63 formed respectively on the second side walls 311 and extending into the slide grooves 62. The pivot pins 33 are slidable along and are rotatable in the slide grooves 62 when the projections 61 are disengaged from the holes 60 to permit opening of the upper lid portion relative to the lower body portion. In assembly, the upper lid portion 31 is pulled upwardly to disengage the projections 61 from the holes 60. The pivot pins 63 are moved along the slide grooves 62 adjacent to the cable receiving end 33. The signal transmission cable 4 is then inserted into the cable receiving space 32 in a manner as described in the first preferred embodiment. Next, the pivot pins 63 are moved along the slide grooves 62 respectively adjacent to the mating end 35. In this position, the upper lid portion 31 is turned about the pivot pins 63 to snap the projections 61 into the holes 60. As such, the upper lid portion 31 can be locked to the lower body portion 31 to position the signal transmission cable 4 firmly in the dielectric housing 3.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A modular plug comprising:

a dielectric housing having a cable insertion end, a mating end opposite to said cable insertion end, a lower body portion, and an upper lid portion connected to said lower body portion, said lower body portion extending from said cable insertion end to said mating end, said lower body portion having a plurality of terminal grooves formed adjacent to said mating end, and a cable receiving space extending from said cable insertion end adjacent to said terminal grooves, said upper lid portion being movable relative to said lower body portion to expose said cable receiving space;

a plurality of terminals inserted into said cable receiving space through said terminal grooves; and a signal transmission cable received in said cable receiving space and having a plurality of conductive wires extending adjacent to said terminal grooves respectively and connected electrically to said terminals;

said upper lid portion lying over said cable receiving space without extending to said terminal grooves and having a protrusion projecting into said cable receiving space to press said signal transmission cable against said lower body portion.

2. The modular plug as claimed in claim 1, wherein said conductive wires are twin-twisted strands, said twin-twisted strands being arranged in said cable receiving space without being untwisted.

3. The modular plug as claimed in claim 1, wherein said dielectric housing further has means for interlocking said upper lid portion and said lower body portion.

4. The modular plug as claimed in claim 3, wherein said lower body portion has two opposed first side walls extending from said mating end to said cable insertion end, said lid having two opposed second side walls extending along lines parallel to said first side walls, said interlocking means including two pairs of holes formed respectively in said first side walls adjacent to said mating end and said cable insertion end, said upper lid portion having two pairs of projections formed respectively on said second side walls and snapping correspondingly into said holes.

5. The modular plug as claimed in claim 3, wherein said lower body portion has two opposed first side walls extending from said mating end to said cable insertion end, said lid having two opposed second side walls extending along lines parallel to said first side walls, said interlocking means including a pair of holes formed respectively in said first side walls adjacent to said cable insertion end, and two slide grooves formed respectively in said first side walls and extending in a direction from said mating end to said cable insertion end, said upper lid portion having a pair of projections formed respectively on said second side walls adjacent to said cable insertion end and snapping correspondingly into said holes, and two pivot pins formed respectively on said second side walls and extending into said slide grooves, said pivot pins being slidable along said slide grooves and being rotatable in said slide grooves when said projections are disengaged from said holes to permit opening of said upper lid portion relative to said lower body portion.

6. The modular plug as claimed in claim 1, wherein said conductive wires at least includes a first twin-twisted strand for transmitting signals and a second twin-twisted strand for telephone use that extend respectively in said cable receiving space at different levels and that are isolated from one another.

7. The modular plug as claimed in claim 6, wherein said terminal grooves are located above said cable receiving space, said first twin-twisted strand being located above said second twin-twisted strand.

8. The modular plug as claimed in claim 7, wherein said conductive wires further includes a third twin-twisted strand for receiving signals and a fourth twin-twisted strand for modems, said third and fourth twin-twisted strands being located below said first twin-twisted strand.

* * * * *